US006215466B1

(12) United States Patent
Yamazaki et al.

(10) Patent No.: US 6,215,466 B1
(45) Date of Patent: Apr. 10, 2001

(54) METHOD OF DRIVING AN ELECTRO-OPTICAL DEVICE

(75) Inventors: Shunpei Yamazaki, Tokyo; Masaaki Hiroki; Yasuhiko Takemura, both of Kanagawa, all of (JP)

(73) Assignee: Semiconductor Energy Laboratory Co., Ltd., Kanagawa-ken (JP)

( * ) Notice: Subject to any disclaimer, the term of this patent is extended or adjusted under 35 U.S.C. 154(b) by 0 days.

(21) Appl. No.: 07/957,107

(22) Filed: Oct. 7, 1992

(30) Foreign Application Priority Data

Oct. 8, 1991 (JP) ..... 3-290722

(51) Int. Cl.[7] ..... G09G 3/36
(52) U.S. Cl. ..... 345/89; 345/148
(58) Field of Search ..... 340/805, 793, 340/784; 345/208, 89, 87, 90, 94, 99, 100–148

(56) References Cited

U.S. PATENT DOCUMENTS 4,130,777 * 12/1978 De Jule ..... 315/169 TV
4,427,978 * 1/1984 Williams ..... 340/793
4,775,891 * 10/1988 Aoki ..... 340/784
5,010,327 * 4/1991 Wakita et al. ..... 340/805
5,010,328 * 4/1991 Morris et al. ..... 345/208

* cited by examiner

*Primary Examiner*—Vivian Chang
(74) *Attorney, Agent, or Firm*—Eric J. Robinson; Nixon Peabody LLP

(57) ABSTRACT

For a gradation displaying operation for an electro-optical device, a gradation display system which can be controlled by a digital signal and is hard to be affected by variation in characteristics between respective elements and which can achieve high gradation, is provided. In the active matrix type electro-optical device, by the digital control of time and amplitude of a voltage pulse applied to each picture element electrode, composite pulses having plural voltage values and pulse widths are formed for one frame of an image so that an average effective voltage of the one frame of the image is made an arbitrary value, thereby finally displaying an intermediate color tone on liquid crystal.

9 Claims, 5 Drawing Sheets

METHOD OF DRIVING AN ELECTRO-OPTICAL DEVICE

BACKGROUND OF THE INVENTION

1. Field of the Invention

This invention relates to a display method for a high-gradation displaying operation in an electro-optical display device constructed by plural picture elements which are arranged in a matrix form and have driving switch elements, such as a liquid crystal display, a plasma display, a vacuum microelectronics display and the like.

2. Description of Related Art

The recent miniaturization of various office automation equipments has caused a conventional cathode ray tube (CRT) to be replaced by a thin-type display (flat panel display) such as a plasma display, a liquid crystal display and the like. In addition, there has been also researched a vacuum microelectronics display in which micro vacuum tubes each comprising a field emission cathode and a grid are arranged in a matrix array and an image is displayed by irradiating an electron beam emitted from the matrix array onto fluorescent material. In all the display devices as described above, an image display operation is performed by controlling a voltage to be applied to intersections of the matrix array.

That is, a transmitted-light amount or a scattered-light amount is varied by an electric field in a display of liquid crystal material, an electric discharge is induced between electrodes by an electric field in a plasma display, and electrons are emitted from a cathode by field emission effect in a vacuum microelectronics display.

The simplest one of these matrix types is a display including a pair of substrates which are confronted to each other, and striped wirings which are arranged longitudinally and laterally on the respective substrates, a voltage being generated in a gap between any intersected longitudinal and lateral wirings by applying a voltage therebetween. This type is called as a simple matrix-structure. This type of display can be produced easily and at low cost because of its simple structure. However, in this type of display, there has been frequently occurs a phenomena called as crosstalk in which an image is blurred due to unintentional signal flow into undesired parts in a driving operation of the display. In order to avoid the crosstalk, material whose optical characteristic varies sharply with a voltage above a predetermined threshold voltage is required. For example, a plasma electric discharge display is a favorable display for such a simple-matrix system because it has a distinct threshold value as described above.

When such an optical material as described above is used, however, the display must be driven such that a voltage for each picture element (that is, a crossing between matrix wirings) is extremely near to the threshold voltage. Therefore, when the simple matrix system is adopted, an optical ON/OFF-switching operation can be carried out, but it is difficult to obtain an intermediate brightness or color tone because material which can. vary its brightness in an intermediate variable range in accordance with an applied voltage can not be used as an optical material for the display.

This problem is caused by placing the switching function on an optical material (liquid crystal or electric discharge gas). Therefore, an attempt of installing a switching element to the matrix independently of the optical material was tried. This type of device is called as an active matrix display and has one or more switching elements at each picture element.

A PIN diode, an MIM diode or a thin film transistor or the like is used as a switching element.

However, even though an active matrix system is adopted, it is difficult to achieve a display operation with high gradation as realized in CRT.

FIG. 1(A) shows a conventional gradation display system. In FIG. 1(A), the ordinate represents the amplitude of a voltage applied to a specified picture element and the abscissa represent a time, and this figure represents the variation of the voltage applied to a picture element of a liquid crystal display. The voltage is applied in the form of an alternative current pulse because the liquid crystal would be deteriorated due to its electrolysis if it is applied with a direct current for a long time.

In this figure, the voltage is applied so as to display brightness of "8" in first two periods, "4" in next one period and "6" in last one period. Actually, the liquid crystal material varies in its optical characteristic sharply at a particular threshold value, but it is assumed here that the optical characteristic varies linearly in accordance with the applied voltage. This approximation is a very close approximation for the liquid crystal material such as dispersion type liquid crystal material for example. Thus, in order to achieve the display operation with 16-step gradation for example, it is required to control a voltage at 16 steps and then apply it to a picture element.

In a usual liquid crystal material, its optical characteristic is saturated when applied with a voltage over 5 volts, and hardly varies even if a voltage above 5 volts is applied. In order to implement 16-step gradation displaying operation for example, a voltage must be applied with precision of 300 mV which is obtained by dividing 5 volts by 16. It is reasonable that the implementation of a higher-gradation display operation requires a more minute voltage to be applied to the picture element. However, it is not easy to generate a voltage with a resolution of 300 mV or less, and such a minute voltage is attenuated by various factors until it reaches the picture element. These factors contain resistance of wirings, resistance of thin film transistors, reduction of potential of a picture element due to a parasitic capacitance of the thin film transistors and the like. Since these parameters causing the voltage variation or fluctuation are different in accordance with an active element of each picture element, the fluctuation of the voltage of the picture element can be actually suppressed in a range of plus and minus 0.2 V at maximum over the whole panel.

On the other hand, there is another method of implementing a gradation displaying operation by controlling a time length (retention time) of a voltage pulse to be applied to each picture element. For example, display methods as disclosed in Japanese patent application Nos. 3-169306, 3-169307, 3-209869, etc. which have been invented by the same inventors as this application are cited as examples of the above method. FIG. 1(B) shows this example. First two periods are used for brightness of "8", next one period is used for brightness of "4" and last one period is used for brightness of "6", as well as the method of FIG. 1(A).

It is known that the liquid crystal material visually functions to display color tone and brightness in accordance with, not an instantaneous voltage, but an average effective voltage. Namely, assuming an effective voltage of first two periods as 1, the next one period is considered as 0.5 though it has the same peak voltage as that of the first two periods, and the last period is considered as 0.75.

Further, a response speed of the plasma electric discharge is a high speed of 1 micro second, but a human naked eye cannot follow such a high speed, and can sense only an average brightness, so that a visual brightness is finally determined by an average effective voltage.

That is, the gradation displaying system as described above requires the switching speed to be remarkably increased particularly in order to implement a high-gradation displaying operation.

FIG. 2 shows a special case of FIG. 1(B), and an example of FIG. 2 can achieve 64-step (64-level) gradation displaying, operation. Numbers at the left side represent degree of brightness of picture elements. In this example, the optical characteristic varies from "1" to "54" in this order. In FIG. 2, (A) and (B) are not different essentially, and only the order of plural pulses is altered therebetween. The details of this example are described in Japanese patent application No. 3-209869 which has been invented by the same inventors as this application and thus the description thereof is eliminated.

For example, in a part marked as "17", a pulse whose length is 1 and a pulse whose length is 16 appear once in a period of s respectively, and it represents an average brightness of "17". Further, in a part marked "37", a pulse whose length is 1, a pulse whose length is 4 and a pulse whose length is 32 appear once in a period of s, and it represents an average brightness of "37". By this way, 64-step gradation display from "0" to "64" can be achieved.

It is apparent from FIG. 2 that the minimum pulse length is required to be one 64th of a voltage repetitive period of s. In a case where a switching operation is actually carried out using a thin film transistor or the like, a pulse whose width is shortened in accordance with the number of lines of matrix is applied to the thin film transistor. For example, when the matrix has 480 lines, a pulse whose width is one 480th of the minimum pulse length is applied to the thin film transistor. Since s is usually 30 msec, the minimum pulse width becomes 500 micro sec. Thus, 1 micro sec is required for a driving signal for the thin film transistor or the like. This value may be considered as a large value, but it is very rapid signal for the thin film transistor. Therefore, in order to achieve higher gradation displaying operation, more rapid pulses must be applied, and by this, electromagnetic wave is radiated from the display.

SUMMARY OF THE PRESENT INVENTION

This invention has been implemented to solve the problems described above in a conventional gradation displaying system, and is a new type of gradation displaying system which adopts advantages of both of a gradation displaying system which is completely dependent on a voltage as shown in FIG. 1(A) and a gradation displaying system which is completely dependent on a pulse width as shown in FIG. 1(B). In addition, in this system, both of the remarkably minute voltage control and the remarkably short-speed pulse as pointed out above are not required.

A method of driving an electro-optical device of an active matrix structure in accordance with the present invention comprises applying a voltage comprising pulses of a plurality of pulse heights and a plurality of pulse widths to a pixel of the electro-optical device.

In order to distinguish this invention from the conventional system clearly, an embodiment of this invention is shown in FIG. 1(C). First two periods are used for brightness of "8", next one period is used for brightness of "4" and last one period is used for brightness of "6", like the systems as shown in FIG. 1(A) and FIG. 1(B).

In this invention, the gradation displaying operation is also achieved by utilizing an average effective voltage as well as the system as shown in FIG. 2, however, in this invention, a degree of freedom is increased by varying not only a pulse width, but also a pulse height to solve the above problems.

First, in FIG. 1(C), first two periods are the same as others, and assuming a voltage at these periods as 1 volt, of course, an average effective voltage of the first two periods becomes 1. An average effective voltage at a next one period is 0.5 because in the next one period a pulse height is a half of that at the first two periods. In a last one period, complicated pulses are combined. However, a pulse having pulse height of 1 first appears, and subsequently a pulse having pulse height of 0.5 appears. Since these two pulses are retentive for the same time, an average effective voltage becomes 0.75. As described above, by controlling not only the pulse width but also the pulse height, a load imposed on pulse length (high-speed pulsation) can be reduced by the pulse height.

In FIG. 2, the 64-step (64-level) gradation displaying operation is achieved by combination of total 6 pulses whose width is 1, 2, 4, 8, 16 and 32. On the other hand, in this invention, the pulse height is sectioned into five steps (levels) of 0, 1, 2, 3 and 4, and only four pulses having pulse width of 1, 2, 4 and 8 are used to implement the 61-step gradation displaying operation. Of course, a small number of kinds of pulses means that the minimum pulse width is large.

FIG. 3 shows an example. FIGS. 3(A) and (B) are essentially identical to each other except that the pulse order is altered. In the example of FIG. 3, "1" can be represented by a pulse whose height is 1 and whose width is 1 (minimum pulse). "2"can be represented by a pulse whose height is 1 and whose width is 2. "4" can be represented by a pulse whose height is 1 and whose width is 4. "8" can be represented by a pulse whose height is 1 and whose width is 8. "16" can be represented by a pulse whose height is 2 and whose width is 8. "32" can be represented by a pulse whose height is 4 and whose width is 8. These pulses can be represented by combination of pulses having another pulse height and pulse width. As shown in the FIG. 3, all numbers from "0", "1" to "60" can be represented by a combination of these pulses. It is apparent from this figure that the minimum pulse width becomes longer than that of the conventional system. In the example of FIG. 3, the minimum pulse width is four times of that of FIG. 2. That is, increase of power consumption due to a high-speed operation and a load imposed on the device can be remarkably reduced.

For example, dividing the pulse height into five steps (levels) of 0, 1, 2, 3, 4 and using three kinds of pulses having pulse widths of 1, 2, 4, the maximum number which can be represented by the above pulses is "28", which is obtained by adding a pulse whose width is 1 and whose height is 4, a pulse whose width is 2 and whose height is 4 and a pulse whose width is 4 and whose height is 4, and all numbers from "0" to "28" can be represented by combination of these three pulses.

Assuming a number to be represented as "N", this problem is a problem to find out combinations of figures (KLM) where $$N=1\times K+2\times L+4\times M$$

(where K, L, M represents any one of 0, 1, 2, 3, 4)

Solutions of this problem are shown in Table 1.

When this problem is generalized, this problem turns out to be a proof of the following theorem;

[Theorem]

in an equation;

$$N=n_0+2n_1+2^2n_2+\ldots+2^kn_k$$

$$(n_0, n_1, n_2, \ldots, n_k\ 0, 1, 2, \ldots, I), \quad (1)$$

N may be (can represent) any integer below the following maximum value;

$$N_{max}=(1+2+2^2+\ldots+2^k)I \quad (2).$$

An example shown in Table 1 corresponds to a case of this theorem where k=2 and I=4, and an example shown in FIG. 3 corresponds to a part of a case where k=3 and I=4. In cases where k=4 and I=4 (125 gradations) and where k=5 and I=4 (253 gradations), however, trueness of this theorem is unknown. The trueness of the theorem is unclear for a higher-gradation displaying operation. Therefore, the proof therefor is required.

This proof will be made as follows. First of all, considering the theorem as described above for I=1, the theorem is proved to be true. Namely, By the following equation:

$$N=n_0+2n_1+2^2n_2+\ldots+2^kn_k$$

$$(n_0, n_1, n_2, \ldots, n_k\ 0, 1)$$

where k is an arbitrary positive integer, all from 0 to $(1+2+2^2+\ldots+2^k)$ can be represented (sub theorem 1). Since the proof for this theorem is very easy, it is omitted here.

Next, the theorem is assumed to be true for I=i (i represents an arbitrary positive integer)(assumption 1). Under the above assumption, it is examined whether the theorem is true or not for I=i+1.

The maximum value of N for I=i is represented by Nmax (represented by the equation (2)), and the maximum value of N for I=i+1 is represented by N'max.

$$N'max=(1+2+2^2+\ldots+2^k)(i+1) \quad (3).$$

Now, it is true that all integers from 0 to Nmax can be represented by the following series:

$$N=n_0+2n_1+2^2n_2+\ldots+2^kn_k$$

$$(n_0, n_1, n_2, \ldots, n_k\ 0, 1, 2, \ldots, i, i+1) \quad (4).$$

Because, from the assumption 1, it supposed to be true that all integers from 0 to Nmax can be represented by the series (4) which uses only number of $n_0, n_1, n_2, \ldots, n_k\ 0, 1, 2, \ldots, i$ (i+1 is not used).

Next, it will be examined whether any integer from Nmax+1 to N'max can be represented or not. An arbitrary integer N' contained in this region is represented by $$N'=Nmax+m=(1+2+2^2+\ldots+2^k)i+m \quad (5).$$

Where m represents a figure from 1 to $(1+2+2^2+\ldots+2^k)$, and by the sub theorem 1 as mentioned above, m is represented by;

$$\text{equation } m=1_0+21_1+2^21_2+\ldots+2^k1_k$$

$$(1_0, 1_1, 1_2, \ldots 1_k\ 0, 1).$$

Thus, the equation (5) is;

$$N'=(1+2+2^2+\ldots+2^k)i$$

$$+1_{0+211}+2^21_2+\ldots+2^k1_k$$

$$(1_0, 1_1, 1_2, \ldots 1_k\ 0, 1) \quad (5)'.$$

A polynomial equation (5)' is transformed to the second power series:

$$N'=n_0+2n_1+2^2n_2+\ldots+2^kn_k$$

$$(n_0, n_1, n_2, \ldots, n_k\ i, i+1) \quad (6).$$

Thus, it is proved that this theorem is also true for I=i+1. Therefore, by the mathematical inductive method, it is proved that the theorem as mentioned above is true for an arbitrary positive integer k and I.

As described above, greatly multiple steps of average voltages can be represented by combinations of pulses whose width and height are different from one another. In this invention, a pulse voltage must be set to plural values above 2 steps (levels), for example, 5 steps (levels). However, setting a threshold voltage of liquid crystal to 5V, these levels are set to 0V, 1.25V, 2.5V, 3.75V and 5V, and using these voltage levels, 61-step gradation displaying operation can be achieved in the case as shown in FIG. 3. On the other hand, in the conventional system as shown in FIG. 1(A) where a voltage must be minutely divided (sectioned), in order to achieve the 61-step gradation displaying operation, an input voltage must be stepwisely divided by 80 mV and this is impossible to be carried out. The above is an essential part of this invention, and actually, a signal input to each display device is more complicated.

DETAILED DESCRIPTION OF THE PREFERRED EMBODIMENT

Figure 4:
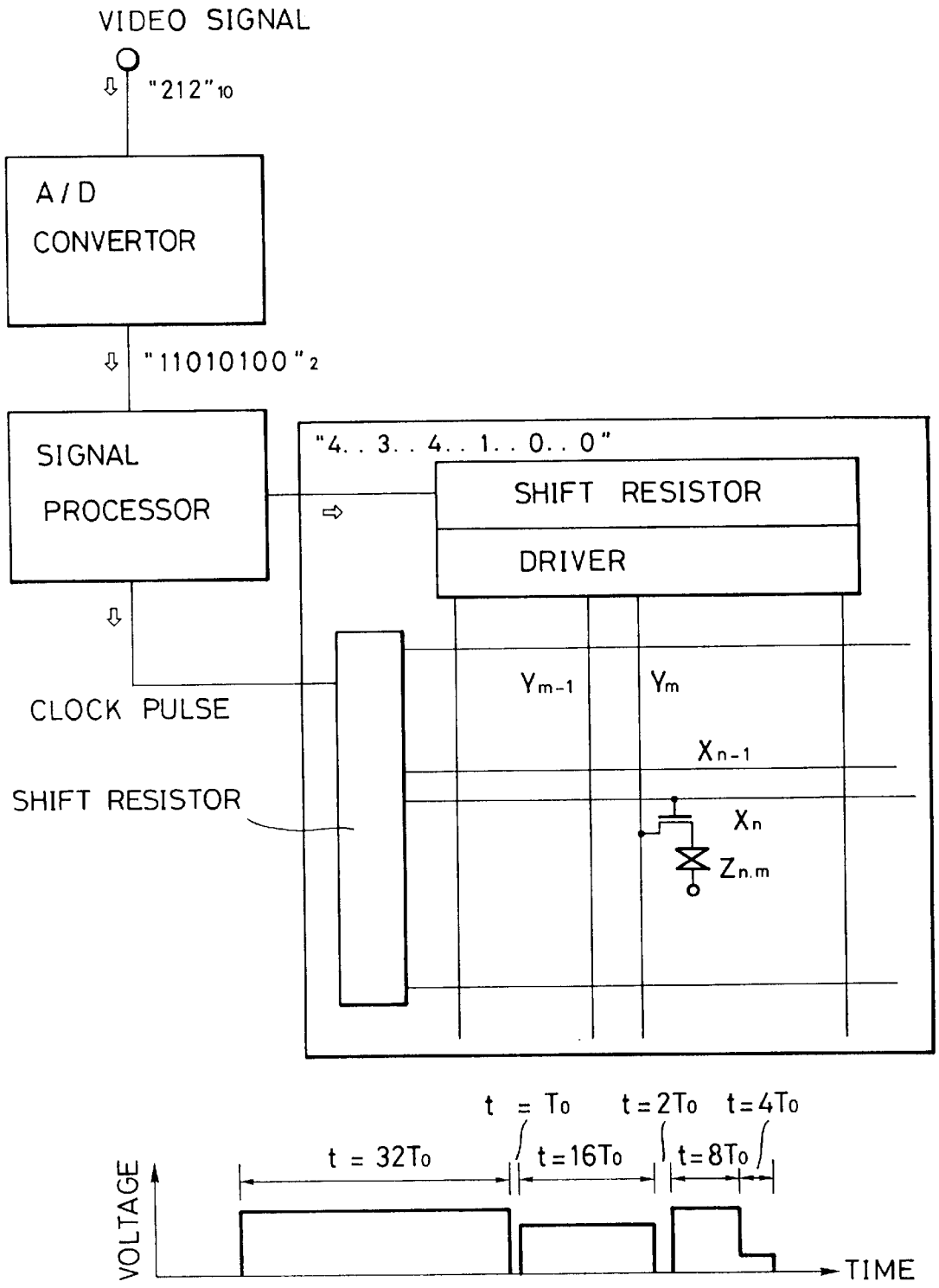
FIG. 4 shows an embodiment of an image display device to which this invention is applied.

FIG. 4 is a schematic diagram of a display device for implementing this invention. In the device shown here, only indispensable parts to explain this invention are described, and other various equipments may be required to actually operate the device. This device is assumed to carry out the 61-step gradation displaying operation.

First of all, a video signal is input from an input terminal of this device. Here, the input video signal is assumed to be a signal for a picture element on an n-th column and an m-th row of an image, whose brightness is represented with "212" when the maximum value of brightness is assumed as 256. Of course, other signals are input into this device continually.

After input into the device, this signal is converted to a binary digital signal by an A/D converter. "212" corresponds to "11010100" in binary expression. In this invention, however, only this digital signal cannot be used directly.

Accordingly, this digital signal is converted to a signal which is suitable for this invention by a signal processor at next stage.

In this device, six kinds of pulses whose pulse widths are $T_0$, $2T_0$, $4T_0$, $8T_0$, $16T_0$, $32T_0$ are used, and the pulse height thereof is divided into 5 levels (0, 1, 2, 3, 4).

In this device, a digital signal "11010100" is converted to "434110". This signal converting operation may be carried out one by one, but output signals which correspond to input signals are preferably memorized beforehand in a memory device inside of a signal processing device and outputted in correspondence to the input signals in consideration of limitation of signal processing speed. Such data are shown in Table 2, for example. In this Table, N is represented by decimal notation, but in a practical processing step, it has been converted to a binary number. This conversion process has no problem because this process is carried out in one-to-one correspondence. "Signal" represents an output signal.

Signals output from the signal processing device are not output continuously like "434100". Namely, since other picture element data must be output simultaneously, these signals are outputted intermittently like " . . . 4 . . . 3 . . . 4 . . . 1 . . . 0 . . . 0 . . . ". A clock pulse is also output simultaneously.

As described above the signals output from the signal processing device are transmitted to a shift resistor on the periphery of a screen. Here, each signal is transmitted to a corresponding signal line (Y line) and stored in capacitor or the like and held there until it is outputted. When a driver turns on, a signal voltage is discharged to each Y line. On the other hand, the clock pulse is transmitted to a shift resistor of a gate line (X line) and the signal is successively transmitted to each gate line.

This device adopts a mechanism in which the voltage value of 4 or 3 is generated by the signal processing device and held in the capacitor. However, a signal output from signal processing device may be converted to a digital signal corresponding to the voltage value "4" or "3" (for example "100" or "011"), and then a circuit for generating these signals may be connected to each Y line. In a case of using a capacitor, a pulse voltage is not a rectangular wave, but varies greatly with time lapse, and a voltage held in the picture element varies greatly with only a slight shift of a switching timing. The switching timing is dependent on performance of each thin film transistor and it is difficult to produce transistors under precise control of such an analog characteristic of each transistor using the present technology, and thus it is a factor in reducing the yield of the device.

Though this invention requires no fine control of a voltage in comparison with the conventional active matrix system of pure analog drive, 10% fluctuation of the voltage is enough to deteriorate the gradation by one order.

Thus, the analog method using the capacitor as described above is not favorable for this invention. In this point, in a case of using a system in which the voltage pulse is supplied directly from the voltage generation circuit, a pulse to be applied to the Y line has an excellent rectangular wave, and thus a voltage held in any picture element is substantially constant, so that it is favorable for the high-gradation displaying operation (64-step gradation or 256-step gradation, for example) at which this invention aims.

Figure 5:
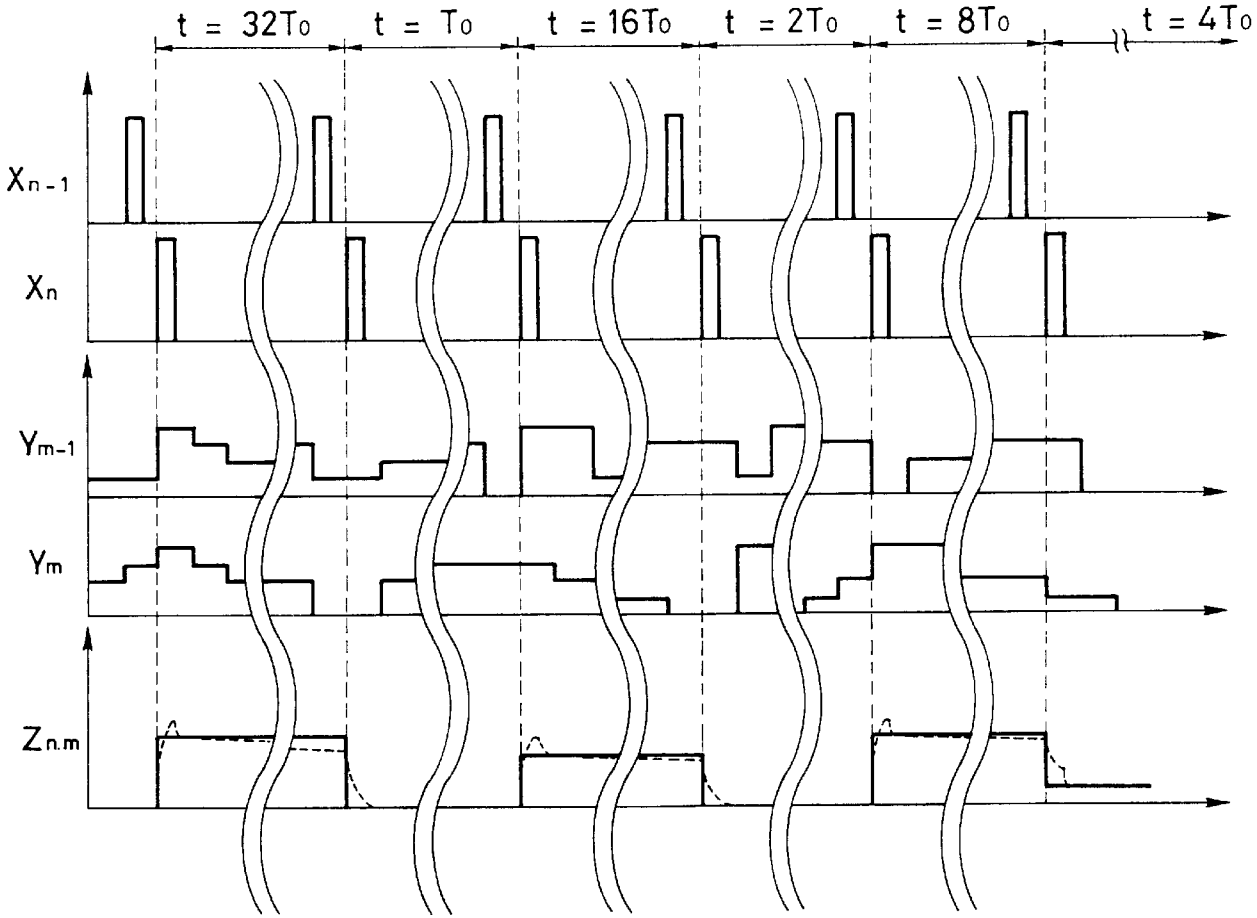
FIG. 5 shows an applied signal, etc. in the embodiment of the image display device to which this invention is applied.

FIG. 5 shows a voltage of a picture element $Z_{n,m}$ on the n-th column and the m-th row and a voltage between a gate line $X_n$ and a signal line $Y_m$ (which is also called drain line) which is applied to the picture element. In the figure showing the voltage of the picture element pixel $Z_{n,m}$, a broken line represents an actual signal and a solid line represents an ideal signal. A voltage applied to the picture element does not have an ideal rectangular wave due to various factors. That is, the main factors are a voltage drop due to a so-called diving voltage which is caused by overlap of the gate electrode and the source region, a voltage drop caused by natural discharge from a picture element electrode, and a delay of ON/OFF switching operation of the thin film transistor. Although the analog type voltage supply means is not adopted, the disorder of the signal waveform as described above due to the analog factors in the active matrix is not favorable for this invention as described above. Thus, these factor must be considered fully for a practical circuit design.

As shown in FIG. 5, in a picture element, a highest-voltage state (4-voltage state) first continues for $32T_0$, subsequently the zero-voltage state is kept for $T_0$, subsequently a 3-voltage state continues for $16T_0$, subsequently the voltage is kept to zero for $2T_0$, and subsequently a 4-voltage state continues for $8T_0$, and a 1-voltage state continues for a last $4T_0$. Through this operation, an average voltage of 212/63 per time $T_0$ can be obtained.

The voltage of the picture element $Z_{n,m}$ at this time is an assembly of rectangular pulses as shown in a lower part of FIG. 4. Assuming a period of 1 frame as 17 msec, $T_0$=270 micro seconds, and the width of pulses applied to a gate electrode is 300 nsec when total number of X lines is 480. The minimum width of the pulse signal applied to the Y line is also 600 nsec. These numbers correspond to several MHz frequency.

Figure 1A:
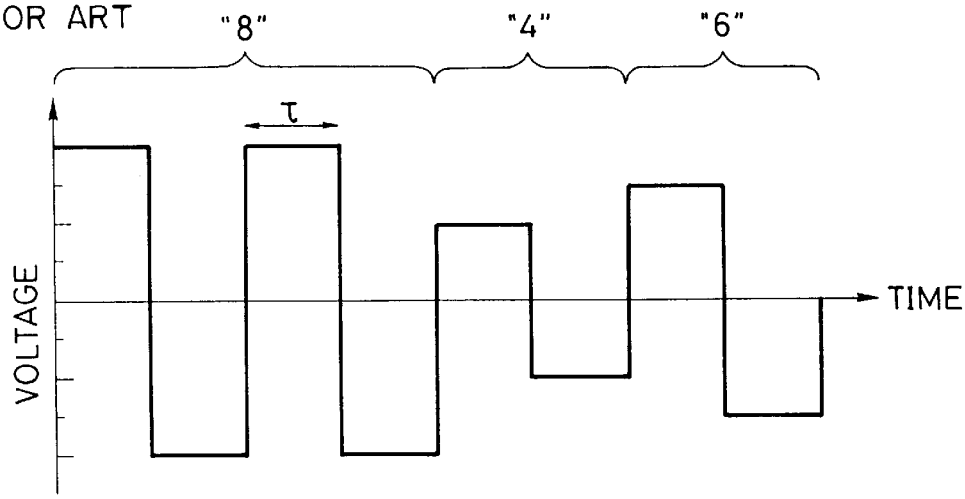
FIG. 1(A) PRIOR ART
FIG. 1 shows gradation displaying method of this invention and the prior art.
Figure 1B:
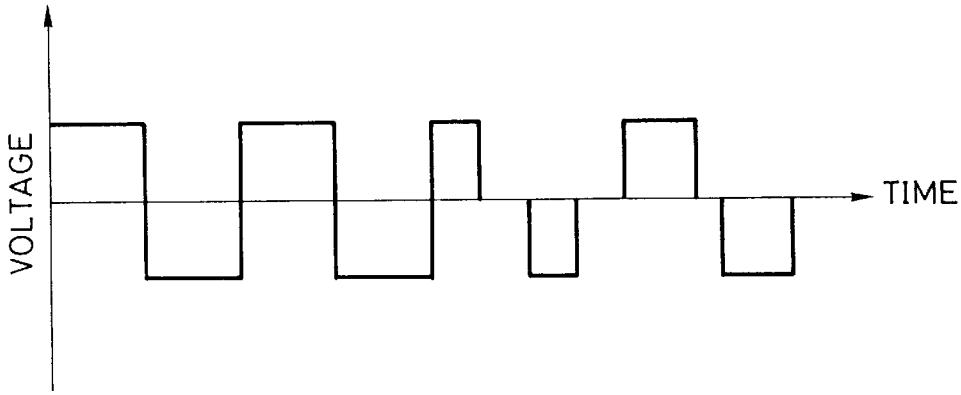
FIG. 1(B) PRIOR ART
Figure 1C:
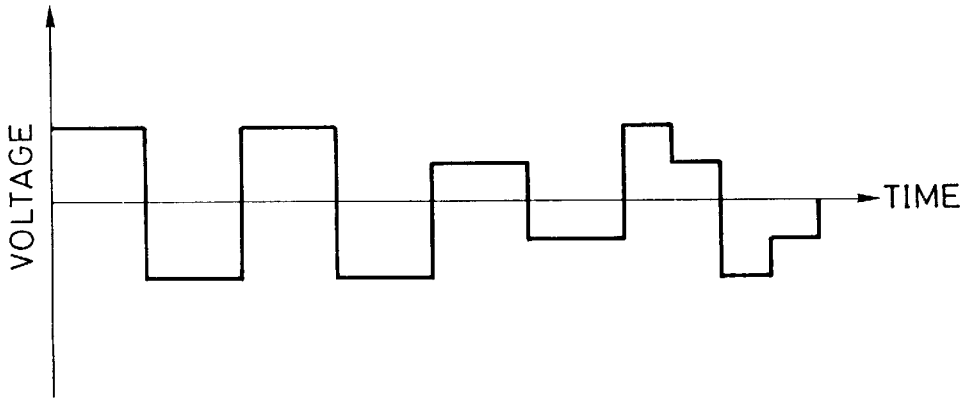
FIG. 1(C) PRIOR ART
Figure 2A:
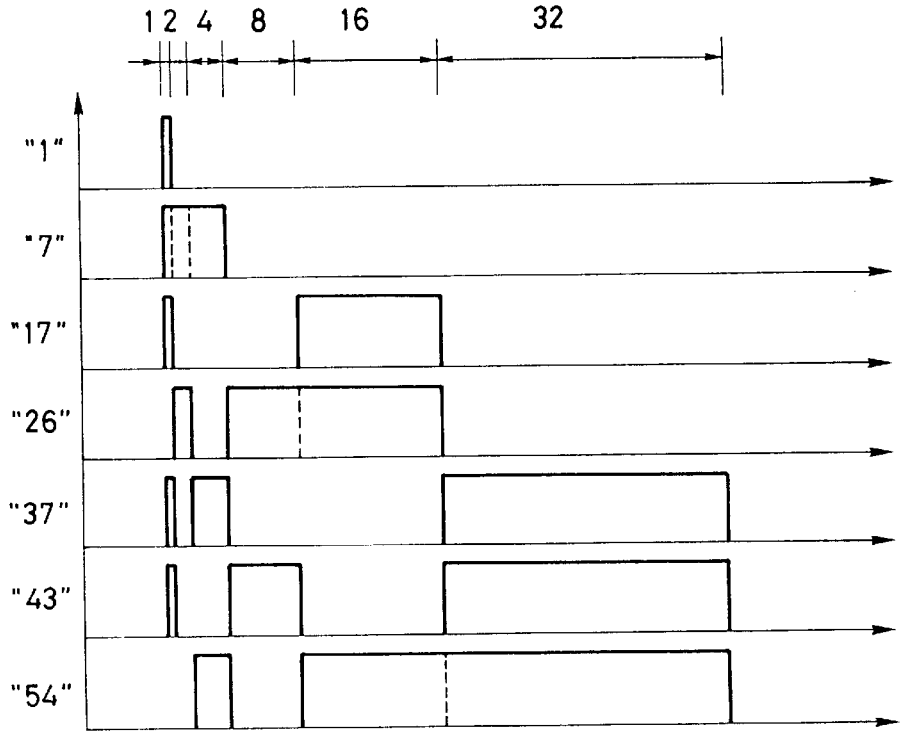
FIG. 2(A) PRIOR ART
FIG. 2 shows an example of the conventional gradation displaying method.
Figure 2B:
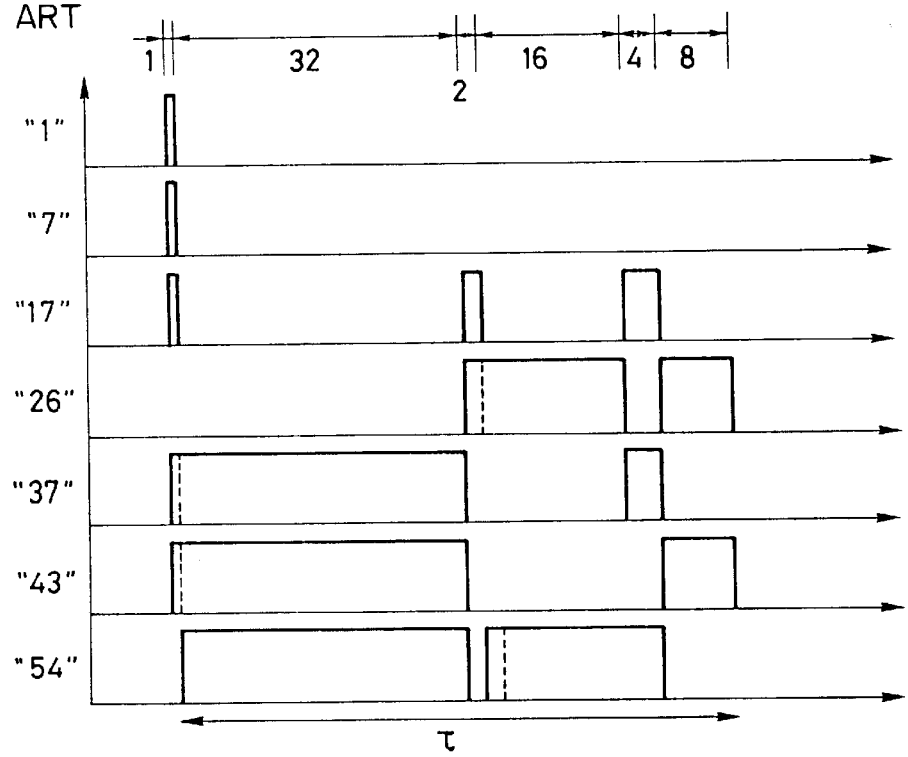
FIG. 2(B) PRIOR ART
Figure 3A:
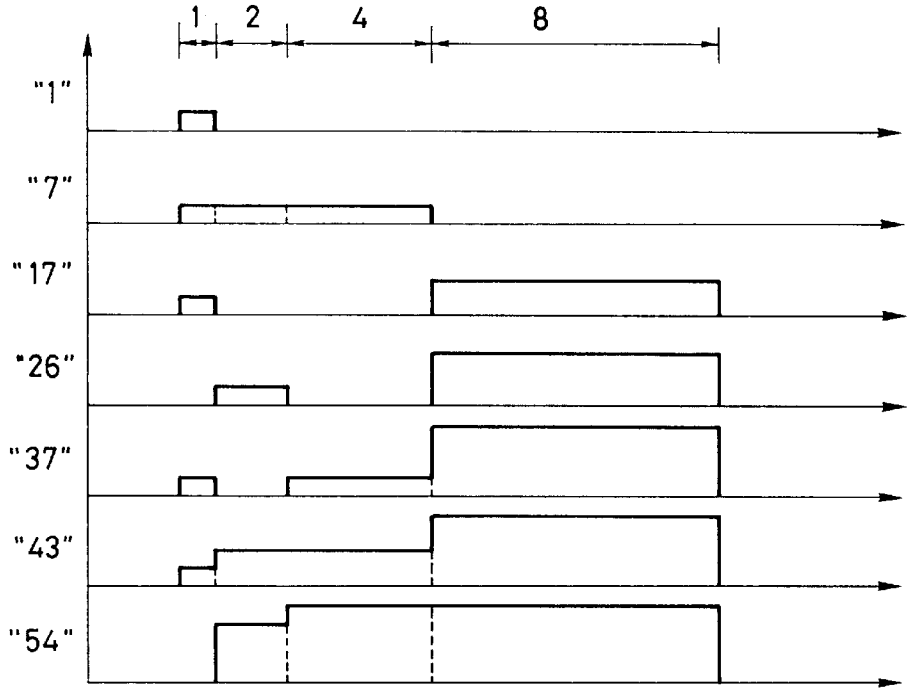
FIG. 3 shows an example of the gradation displaying method of this invention.
Figure 3B:
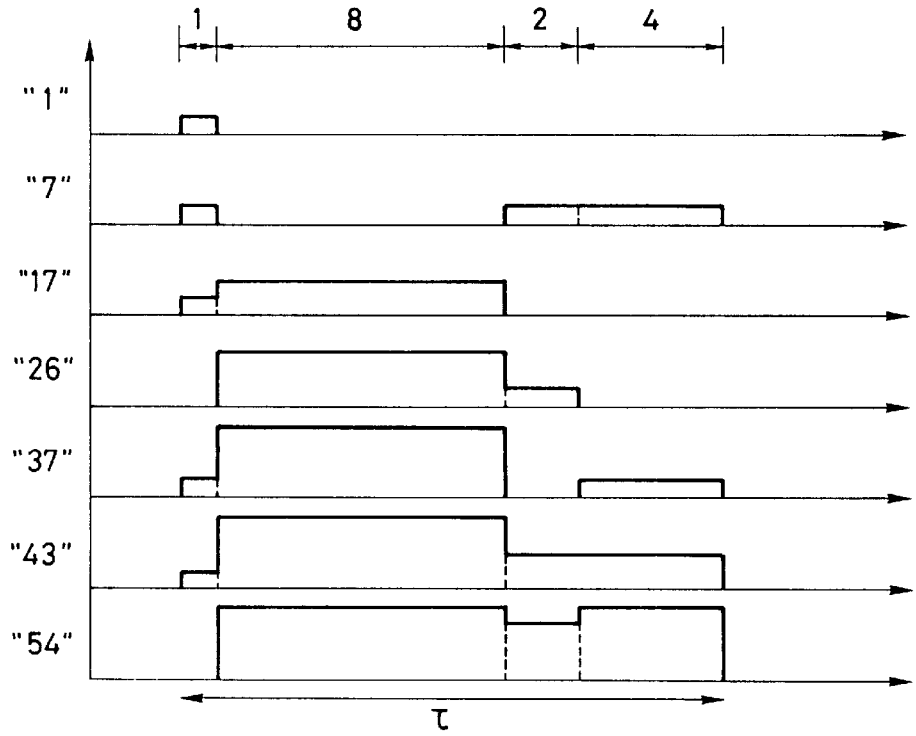

On the other hand, in the conventional system (FIG. 2), a gate pulse of 75 nsec which is about one fourth of the above value is required. This corresponds to 13 MHz frequency, and in order to achieve such a high-speed operation, for example, it has been required to produce an active element in CMOS form. Further, an electromagnetic wave which is radiated from a display due to the high-frequency driving as described above has induced a problem. However, such a problem rarely occurs in this invention. Of course, the active element produced in the CMOS form can be also available for this invention.

According to this invention, an image having remarkably high gradation can be obtained. This invention is particularly suitable for the liquid crystal display, however, it is applicable to other display systems such as a plasma display, a vacuum microelectro display, etc. Optical material which has not only an ON/OFF switching function, but also an intermediate optical characteristic in accordance with an applied voltage is particularly favorable to this invention.

Therefore, this invention can be implemented particularly using any material whose optical characteristic varies in accordance with an applied voltage, and which develops the intermediate state with the applied voltage.

TABLE 1

*N* = 1 + 2m + 4n

| N | (1 mn) |
|---|---|
| 0 | (000) |
| 1 | (100) |
| 2 | (200), (010) |
| 3 | (110), (300), |
| 4 | (210), (400), (001), (020) |

TABLE 1-continued

| N | *N* = 1 + 2m + 4n (1 mn) |
|---|---|
| 5 | (120), (101), (310), |
| 6 | (201), (220), (410), (011), (030) |
| 7 | (130), (111), (301), (320) |
| 8 | (211), (230), (401), (420), (002), (021), (040) |
| 9 | (140), (102), (121), (311), (330) |
| 10 | (202), (221), (240), (411), (430), (012), (031) |
| 11 | (112), (131), (302), (321), (340) |
| 12 | (212), (231), (402), (421), (440), (003), (022), (041) |
| 13 | (103), (122), (141), (312), (331) |
| 14 | (203), (222), (241), (412), (431), (013), (032) |
| 15 | (113), (132), (303), (322), (341) |
| 16 | (213), (232), (403), (422), (441), (004), (023), (042) |
| 17 | (104), (123), (142), (313), (332) |
| 18 | (204), (223), (242), (413), (432), (014), (033) |
| 19 | (114), (133), (304), (323), (342) |
| 20 | (214), (233), (404), (423), (442), (024), (043) |
| 21 | (124), (143), (314), (333) |
| 22 | (224), (243), (414), (433), (034) |
| 23 | (134), (324), (343) |
| 24 | (234), (424), (443), (044) |
| 25 | (144), (334) |
| 26 | (244), (434) |
| 27 | (344) |
| 28 | (444) |

TABLE 2

| N | Signal |
|---|---|
| 001 | 000001 |
| 002 | 000010 |
| 003 | 000003 |
| 004 | 000100 |
| 005 | 000101 |
| 006 | 000030 |
| 007 | 000103 |
| 008 | 001000 |
| 009 | 001001 |
| 010 | 001010 |
| 011 | 001003 |
| 012 | 000300 |
| 013 | 000301 |
| 014 | 000310 |
| 015 | 000303 |
| 016 | 010000 |
| 017 | 010001 |
| 018 | 010010 |
| 019 | 010003 |
| 020 | 010100 |
| 021 | 010101 |
| 022 | 010110 |
| 023 | 010103 |
| 024 | 003000 |
| 025 | 003001 |
| 026 | 003010 |
| 027 | 003003 |
| 028 | 003100 |
| 029 | 003101 |
| 030 | 003110 |
| 031 | 003103 |
| 032 | 100000 |
| 033 | 100001 |
| 034 | 100010 |
| 035 | 100003 |
| 036 | 100100 |
| 037 | 100101 |
| 038 | 100030 |
| 039 | 100103 |
| 040 | 101000 |
| 041 | 101001 |
| 042 | 103000 |
| 043 | 103001 |

TABLE 2-continued

| N | Signal |
|---|---|
| 044 | 103010 |
| 045 | 103003 |
| 046 | 103100 |
| 047 | 103101 |
| 048 | 030000 |
| 049 | 030001 |
| 050 | 030010 |
| 051 | 030003 |
| 052 | 030100 |
| 053 | 030101 |
| 054 | 030030 |
| 055 | 030103 |
| 056 | 031000 |
| 057 | 031001 |
| 058 | 030130 |
| 059 | 031003 |
| 060 | 030300 |
| 061 | 030301 |
| 062 | 030310 |
| 063 | 030303 |
| 064 | 200000 |
| 065 | 200001 |
| 066 | 200010 |
| 067 | 200003 |
| 068 | 200100 |
| 069 | 200101 |
| 070 | 200030 |
| 071 | 200103 |
| 072 | 033000 |
| 073 | 033001 |
| 074 | 033010 |
| 075 | 033003 |
| 076 | 200300 |
| 077 | 200301 |
| 078 | 200310 |
| 079 | 200303 |
| 080 | 130000 |
| 081 | 130001 |
| 082 | 130010 |
| 083 | 130003 |
| 084 | 130100 |
| 085 | 130101 |
| 086 | 130030 |
| 087 | 130031 |
| 088 | 203000 |
| 089 | 203001 |
| 090 | 203010 |
| 091 | 203003 |
| 092 | 203100 |
| 093 | 203101 |
| 094 | 203030 |
| 095 | 203031 |
| 096 | 300000 |
| 097 | 300001 |
| 098 | 300010 |
| 099 | 300003 |
| 100 | 300100 |
| 101 | 300101 |
| 102 | 300030 |
| 103 | 300031 |
| 104 | 301000 |
| 105 | 301001 |
| 106 | 301010 |
| 107 | 301003 |
| 108 | 300300 |
| 109 | 300301 |
| 110 | 300310 |
| 111 | 300303 |
| 112 | 230000 |
| 113 | 230001 |
| 114 | 230010 |
| 115 | 230003 |
| 116 | 230100 |
| 117 | 230101 |
| 118 | 230030 |
| 119 | 230031 |
| 120 | 303000 |

TABLE 2-continued

| N | Signal |
|---|---|
| 121 | 303001 |
| 122 | 303010 |
| 123 | 303003 |
| 124 | 303100 |
| 125 | 303101 |
| 126 | 303030 |
| 127 | 303031 |
| 128 | 400000 |
| 129 | 400001 |
| 130 | 400010 |
| 131 | 400003 |
| 132 | 400100 |
| 133 | 400101 |
| 134 | 400030 |
| 135 | 400031 |
| 136 | 401000 |
| 137 | 401001 |
| 138 | 401010 |
| 139 | 401003 |
| 140 | 400300 |
| 141 | 400301 |
| 142 | 400310 |
| 143 | 400303 |
| 144 | 410000 |
| 145 | 410001 |
| 146 | 410010 |
| 147 | 410003 |
| 148 | 410100 |
| 149 | 410101 |
| 150 | 410030 |
| 151 | 410103 |
| 152 | 403000 |
| 153 | 403001 |
| 154 | 403010 |
| 155 | 403003 |
| 156 | 403100 |
| 157 | 403101 |
| 158 | 403030 |
| 159 | 413101 |
| 160 | 420000 |
| 161 | 420001 |
| 162 | 420010 |
| 163 | 420003 |
| 164 | 420100 |
| 165 | 420101 |
| 166 | 420030 |
| 167 | 420103 |
| 168 | 421000 |
| 169 | 421001 |
| 170 | 421010 |
| 171 | 421003 |
| 172 | 420300 |
| 173 | 420301 |
| 174 | 420310 |
| 175 | 420303 |
| 176 | 430000 |
| 177 | 430001 |
| 178 | 430010 |
| 179 | 430003 |
| 180 | 430100 |
| 181 | 430101 |
| 182 | 430030 |
| 183 | 430103 |
| 184 | 431000 |
| 185 | 431001 |
| 186 | 431010 |
| 187 | 431003 |
| 188 | 430300 |
| 189 | 430301 |
| 190 | 430310 |
| 191 | 430303 |
| 192 | 440000 |
| 193 | 440001 |
| 194 | 440010 |
| 195 | 440003 |
| 196 | 440100 |
| 197 | 440101 |

TABLE 2-continued

| N | Signal |
|---|---|
| 198 | 440030 |
| 199 | 440103 |
| 200 | 433000 |
| 201 | 433001 |
| 202 | 433010 |
| 203 | 433003 |
| 204 | 440300 |
| 205 | 440301 |
| 206 | 440310 |
| 207 | 440303 |
| 208 | 434000 |
| 209 | 434001 |
| 210 | 434010 |
| 211 | 434003 |
| 212 | 434100 |
| 213 | 434101 |
| 214 | 434030 |
| 215 | 434103 |
| 216 | 443000 |
| 217 | 443001 |
| 218 | 443010 |
| 219 | 443003 |
| 220 | 434300 |
| 221 | 434301 |
| 222 | 434310 |
| 223 | 434303 |
| 224 | 444000 |
| 225 | 444001 |
| 226 | 444010 |
| 227 | 444003 |
| 228 | 444100 |
| 229 | 444101 |
| 230 | 444030 |
| 231 | 444103 |
| 232 | 444200 |
| 233 | 444201 |
| 234 | 444210 |
| 235 | 444203 |
| 236 | 444300 |
| 237 | 444301 |
| 238 | 444310 |
| 239 | 444303 |
| 240 | 444400 |
| 241 | 444401 |
| 242 | 444410 |
| 243 | 444403 |
| 244 | 444420 |
| 245 | 444421 |
| 246 | 444430 |
| 247 | 444431 |
| 248 | 444440 |
| 249 | 444441 |
| 250 | 444442 |
| 251 | 444443 |
| 252 | 444444 |

What is claimed is:

1. A method of driving an active matrix display with a plurality of gradation levels, wherein the maximum number of gradation level is $N_{max}$ where $N_{max}=(1+2^1+\ldots 2^k)$ I, k and I each being a natural number, said method comprising the steps of:

providing said active matrix display wherein a plurality of transistors disposed on said display respectively drive a plurality of pixels of the display;

inputting into a pixel of said display one or more pulses, each pulse having a pulse height and a pulse duration depending upon a desired gradation level of the display at said pixel, wherein each of said one or more pulses has a relative pulse duration selected from the group consisting of 1, 2, . . . $2^k$ and has a relative pulse height selected from the group consisting of 0, 1, 2, . . . I so that the pulse duration and the pulse height of said pulses are both varied whereby the minimum width of said pulses can be increased.

2. A method of driving an active matrix display with a plurality of gradation levels, wherein the maximum number of gradation level is $N_{max}$ where $N_{max}=(1+2^1+\ldots 2^k)$ I, k and I each being a natural number, said method comprising the steps of:

providing said active matrix display wherein a plurality of transistors disposed on said display respectively drive a plurality of pixels of the display;

storing in a memory gradation level data in which each level from 0 to N is assigned with one or more pulses determined in accordance with an equation:

$$N=1n_0+2n_1+2^2n_2+\ldots+2^kn_k,$$

where $n_0$, $n_1$, $n_2 \ldots n_k$ each are selected from the group consisting of 0, 1, 2 . . . , I and the width of each one of said one or more pulses is selected from the group consisting of $2_k$ and the height of each one of said one or more pulses is selected from the group consisting of 0, 1, . . . , I, determining a gradation level of an original image data at one pixel;

determining said one or more pulses corresponding to said gradational level based on said gradation level storage data; and inputting into said pixel said one or more pulses so that the pulse duration and the pulse height of said pulses are both varied whereby the minimum width of said pulses can be increased.

3. The method of claim 2 wherein said step of determining a gradation level comprises the step of converting said original image data into a digital signal.

4. The method of claims 1 or 2 wherein said active matrix display is selected from the group consisting of a liquid crystal display, a plasma display and a vacuum microelectro display.

5. The method of claims 1 or 2 wherein there are two pulse heights.

6. The method of claim 5 wherein there are two pulse widths.

7. The method of claims 1 or 2 wherein there are five pulse heights.

8. The method of claim 7 wherein there are four pulse widths.

9. The method of claim wherein there are three pulse widths.

* * * * *

UNITED STATES PATENT AND TRADEMARK OFFICE

CERTIFICATE OF CORRECTION

PATENT NO. : 6,215,466 B1
APPLICATION NO. : 07/957107
DATED : April 10, 2001
INVENTOR(S) : Shunpei Yamazaki et al.

It is certified that error appears in the above-identified patent and that said Letters Patent is hereby corrected as shown below:

IN THE CLAIMS:

Please amend claim 2 as follows:

2. (Amended) A method of driving an active matrix display with a plurality of gradation levels, wherein the maximum number of gradation level is $N_{max}$ where $N_{max} = (1+2^1+ \ldots 2^k)$ I, k and I each being a natural number, said method comprising the steps of:

providing said active matrix display wherein a plurality of transistors disposed on said display respectively drive a plurality of pixels of the display;

storing in a memory gradation level data in which each level from 0 to N is assigned with one or more pulses determined in accordance with an equation:

$$N=1n_0+2n_1+2^2n_2+ \ldots +2^kn_k,$$

wherein $n_0$, $n_1$, $n_2 \ldots n_k$ each are selected from the group consisting of 0, 1, 2 . . ., I and the width of each one of said one or more pulses is selected from the group consisting of [$2_k$] <u>1, 2, . . . $2^k$</u> and the height of each one or more pulses is selected from the group consisting of 0, 1, . . ., I, determining a gradation level of an original image data at one pixel;

determining said one or more pulses corresponding to said gradational level based on said gradation level storage data; and

UNITED STATES PATENT AND TRADEMARK OFFICE

CERTIFICATE OF CORRECTION

PATENT NO. : 6,215,466 B1
APPLICATION NO. : 07/957107
DATED : April 10, 2001
INVENTOR(S) : Shunpei Yamazaki et al.

It is certified that error appears in the above-identified patent and that said Letters Patent is hereby corrected as shown below:

inputting into said pixel said one or more pulses so that the pulse duration and the pulse height of said pulses are both varied whereby the minimum width of said pulses can be increased.

Signed and Sealed this

Nineteenth Day of February, 2008

JON W. DUDAS
*Director of the United States Patent and Trademark Office*